US010022609B2

(12) United States Patent
Medley

(10) Patent No.: US 10,022,609 B2
(45) Date of Patent: Jul. 17, 2018

(54) GOLF TRAINING DEVICE

(71) Applicant: Omar Medley, Rosedale, NY (US)

(72) Inventor: Omar Medley, Rosedale, NY (US)

( * ) Notice: Subject to any disclaimer, the term of this patent is extended or adjusted under 35 U.S.C. 154(b) by 0 days.

(21) Appl. No.: 15/479,771

(22) Filed: Apr. 5, 2017

(65) Prior Publication Data

US 2017/0282043 A1 Oct. 5, 2017

Related U.S. Application Data

(60) Provisional application No. 62/318,327, filed on Apr. 5, 2016.

(51) Int. Cl.
*A63B 69/36* (2006.01)

(52) U.S. Cl.
CPC ..... *A63B 69/3667* (2013.01)

(58) Field of Classification Search
CPC ..... A63B 69/3667
USPC ..... 473/207, 215–219, 257, 261–266, 473/270–273, 275, 277
See application file for complete search history.

(56) References Cited

U.S. PATENT DOCUMENTS 1,676,073 A * 7/1928 Brown ..... A47D 7/002 16/371
2,150,580 A * 3/1939 Crowley ..... A63B 69/3667 33/508
3,166,327 A 1/1965 Champion
3,229,891 A 1/1966 Edelman
3,429,577 A 2/1969 Godden
3,580,584 A 5/1971 Trosko
3,655,297 A * 4/1972 Bolen, Jr. ..... F16C 11/10 135/74
3,744,500 A * 7/1973 Briggs ..... A47C 29/006 135/140
4,702,478 A * 10/1987 Kruse ..... A63B 63/004 135/123
4,718,674 A * 1/1988 Henry ..... A63B 69/3623 473/218
4,925,192 A 5/1990 Forbes
5,042,815 A 8/1991 Sutton
5,139,263 A 8/1992 Feo
5,171,017 A 12/1992 Betancourt
5,215,306 A 6/1993 Cayce
5,328,186 A * 7/1994 Hanson ..... A63B 69/3667 473/218
5,362,060 A 11/1994 Hinson
(Continued)

*Primary Examiner* — Nini Legesse
(74) *Attorney, Agent, or Firm* — McHale & Slavin, P.A.

(57) ABSTRACT

A golf training device comprised of a planar quadrilateral-shaped adjustable frame having vertically extendable sway bars that assists a golfer to establish a proper stance and "body turn" during a golf swing is disclosed. The device can be easily setup and transported to permit repetitive use, is relatively easy to manufacture, and cost-effective. The adjustable frame, designed to be placed on the ground, consists of a first pair of linear telescoping members coupled at each end by a second pair of linear telescoping members, thereby allowing the user to expand the adjustable frame to increase or decrease the total square area of the frame according to the preferences and stance of the golfer. Furthermore, each top side of the first pair of linear members include vertically extendable sway bars to alert the golfer if he/she is "swaying" rather than turning on the back swing or follow-through.

11 Claims, 13 Drawing Sheets

(56) References Cited

U.S. PATENT DOCUMENTS

| | | | | |
|---|---|---|---|---|
| 5,611,738 | A | 3/1997 | Lundquist | |
| 5,695,195 | A * | 12/1997 | John | A63B 63/004 273/400 |
| 6,089,989 | A | 7/2000 | Sutcliffe | |
| 6,612,937 | B1 | 9/2003 | Whelan | |
| 7,819,762 | B2 | 10/2010 | Bernal-Silva et al. | |
| 7,927,228 | B2 | 4/2011 | Rhodes | |
| 8,657,521 | B2 * | 2/2014 | Reeves | A63B 63/004 403/101 |
| 8,696,480 | B2 * | 4/2014 | Sasser | A63B 69/3641 473/208 |
| 2002/0142854 | A1 * | 10/2002 | Collins | A63B 69/0057 473/257 |
| 2005/0227774 | A1 | 10/2005 | Buck | |
| 2008/0020868 | A1 | 1/2008 | Palmer | |
| 2009/0118030 | A1 | 5/2009 | Bernal-Silva et al. | |
| 2011/0111875 | A1 | 5/2011 | Kuhlman | |
| 2013/0316839 | A1 | 11/2013 | Woo et al. | |
| 2014/0121033 | A1 * | 5/2014 | Maddox | A63B 69/3641 473/257 |

* cited by examiner

GOLF TRAINING DEVICE

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/318,327, filed Apr. 5, 2016, entitled "GOLF TRAINING DEVICE". The contents of the above referenced application is incorporated herein by reference in its entirety.

FIELD OF THE INVENTION

The present invention relates generally to a golf training aid useful for improving a golfer's swing; and more particularly, to a training aid device designed to improve the stance, alignment, and "body turn" for the proper execution of a golfer's swing.

BACKGROUND OF THE INVENTION

The golf swing for every golfer is essentially a turning motion around a central core, regardless of body structure or degree of flexibility, which are known to vary greatly from one golfer to another. The execution f an effective golf swing is based upon a series of factors or steps that the golfer must understand and execute: posture, stance, alignment of the feet, ball position, distance to and from the ball, and grip.

A good golf swing starts with proper posture. Good posture is critical for consistent, accurate, and powerful ball striking. Having a proper posture means leaning over ever so slightly, well-balanced on slightly bent knees. When a golfer takes the stance, the width of the stance should be about shoulder wide and the arms should be hanging free. Further, the golfer must properly "address" the ball. At address, the body and stance is positioned perpendicular to the ball, although stance can be adjusted for different shots. Stance is essential to achieve proper balance that will allow the golfer to make an effective "body turn" while striking the ban. Alignment of the feet is a very significant aspect of the swing and affects the trajectory of the ball once struck. The ball is positioned with respect to the golfer's feet before being struck. Thus, foot alignment, along with ball positioning relation to the golfer's feet, provides the golfer's intended line of flight with respect to the distance and direction the golfer intends the struck ball to land. Fortunately, the proper positioning of the feet is essentially a mechanical function which, when mastered, can leave the golfer free to concentrate more specifically on other aspects of the golf swing. It is well-known and accepted that the most important factor in directing the flight of a golf ball is the positioning of the feet relative to the golf ball, i.e. the stance of the golfer. Not only does the golfer's stance generally determine the direction in which the golf ball will go when hit, it also has an effect on the spin which is imparted to the ball when it is hit by the golf club. In general, the ball is positioned near the center of the player's stance for short irons, moving forward of center through the middle and long irons, until it is opposite the heel of the front toot for woods. The grip of the hands on the handle of the golf club must be firm and properly positioned. Timing is the most critical element of the golf swing because it connects all of the different moving parts of the body into one motion. On the backswing (the first part of the swing), the order of movement is as follows: hands, arms, shoulders, hips. The downswing (the second part of the swing) is initiated by the unwinding of the hips. Then, the shoulders and arms follow. Indeed, volumes have been written, instructional videos have been produced, and many make a living teaching about the golf swing and what a golfer should do to perfect it. All instruction and training is for naught, however, if the golfer is not certain where the golf ball will go when it is hit. Thus, it would be advantageous to have a device that allows a novice to properly "address" the ball by positioning his body, i.e. stance, properly before every shot.

Golf instruction is the art of equipping and training golfers to play better golf through improved awareness of swing cause and effects resulting from the actions of their body, the club, and the impact on the golf ball. Most great golfers have a few common elements that make them great including, but not limited to, an anticipated effective result, swing repeatability to produce an action that generates said result, and a strong level of automaticity for long lasting enjoyment of the golf game. Golf instruction can be wide ranging, but many great modern day instructors are able to diagnose a golfer's swing frustrations accurately and present a clear fix that encourages the golfer in the discovery of a lasting "cure" from the specific limitations that affected them, while providing a means to repeatedly implement the recommended "cure". Unfortunately, group or individual golf instruction is often expensive, and many golfers are unable to afford repeated golf instruction for prolonged periods of time. Thus, the need for a reliable and affordable training means that can reinforce some of the important factors in directing the flight of the golf ball is desired.

Teaching professionals usually employ one or more methods to help the golfer achieve proper alignment. One method employed with a right-handed golfer (the same can be done with a left-handed golfer by doing the inverse) is to physically align the golfer's body (feet, knees, hips and shoulders) until it is aligned left of and perpendicular to the ball (usually intended for a driver). Another method employed with a right-handed golfer involves laying a golf club on the ground in a manner that the shaft of the golf club is left and parallel to the ball while having the golfer align his left foot against the club. Visual aids typically yield better results, as they help the golfer fully understand the proper alignment procedure. Yet another method employed involves laying a golf club on the ground, at or near the ball, and aligned or pointing to the intended target, i.e. where the golfer wants the ball to end up when hit. The golfer will assume a stance parallel to the club in order to align his/her body with the intended target and then address the ball. These simple and effective methods have lead to several prior art devices employing visual aids in helping with golfer alignment. For instance, U.S. Pat. Nos. 2,150,580; 3,166,327; 3,229,891; 3,429,577; 4,718,674; 4,925,192; 5,042,815; 5,139,263; 5,362,060; 5,611,738; and 6,089,989 help teach the golfer how to properly align their body with an intended target (where the golfer wants the ball to end up) and how to position a ball properly. The aforementioned patents are representative of numerous patents that relate to golf training devices. The prior art generally shows devices utilizing panels, strips, shafts, etc. to assist in the proper stance, proper alignment, and proper ball position for the golfer. The goal being that, through repetition, the golfer will build a reliable, repeatable golf swing. However, the prior art devices lack in mobility, compactness, and ease in transportation.

What is lacking in the art is a personalized training device designed to assist the golfer to develop an effective repeatable golf swing that can easily be transported from location to location and is cost effective to the user. The invention is, with the exception of identifying the proper grip, designed to assist the golfer to adopt the most effective way to execute posture, stance, alignment of the feet, ball position, and distance to and from the ball.

SUMMARY OF THE INVENTION

A golf training device comprised of a planar quadrilateral-shaped adjustable frame having vertically extendable sway bars that assists a golfer to establish a proper stance and "body turn" during a golf swing is disclosed. The golf training device can be easily set up, broken down, and transported to permit repetitive use in different locations and under different circumstances, is relatively easy to manufacture, and is cost-effective to the user. The adjustable frame, designed to be placed on the ground, consists of a first pair of telescoping linear members coupled at each end by a second pair of telescoping linear members, thereby allowing the user to expand the quadrilateral-shaped adjustable frame. The sets of linear members allow the user to increase or decrease the total square area of the frame according to the preferences and stance of the golfer. Furthermore, each top side of the first pair of linear members includes vertically extendable sway bars to alert the golfer if he/she is "swaying" rather than turning on the back swing or follow-through.

In use, the golf training device is removed from the golf bag and laid on the ground. The golfer then increases the square area of the adjustable frame to a desired position, preferably with one of the linear members parallel to the ball. For a right-handed golfer (by way of example), the golfer will align one fixed member on the frame slightly left of and perpendicular to the ball; the golfer will then position his front foot against the linear member in order to address the ball properly. The golfer may also position the frontmost linear member on the frame at or near the ball, and aligned or pointed to the intended target, being where the golfer wants the ball to end up when hit. The golfer will then assume a stance perpendicular to the linear be in order to align his/her body with the intended target, followed by which he/she will address the ball. Lastly, the sway bars should be positioned at or near contact with the hips, with the intended purpose of making contact with the golfer's hips should the hips shift back or forward, as opposed to the preferred method of rotation of the hips.

Accordingly, it is an objective of the instant invention to provide a golf training device useful for helping to improve the stance of a golfer and prevent sway while the golfer is executing a golf swing.

It is another objective of the instant invention to provide a golf training device that sets up and breaks down in seconds and can be easily carried in or later stored in a golf bag.

Still another objective of the instant invention is to provide a golf training device providing precise, reproducible foot positioning and alignment.

Another objective of the instant invention is to provide a golf training device that allows the golfer to more easily visually observe imbalances and shifts after repeated practice of the proper golf swing while positioning one's self properly within the device.

It is still a further objective of the instant invention to provide a golf training device that will assist the golfer to establish proper stance and balance during a golf swing.

Yet another objective of the instant invention is to provide a golf training device that is simple to use, relatively easy to manufacture, and cost-effective to the user, Still yet another objective of the instant invention is to provide a golf training device that easily assembles and can easily be moved to permit repetitive use of the training device in different locations and under different circumstances, for example public or private driving ranges.

It is another objective of the instant invention to provide a golf training device providing mobility, compactness, and ease in transportation.

It is still another objective of the instant invention to provide a golf training device having a ground based reference system, which will give the golfer an opportunity to compare different stances and the effect these stances have when different clubs are used to accomplish different golf shots.

It is yet still another objective of the instant invention to provide a golf training device having vertically extendable sway bars to alert the golfer if his/her body is "swaying" on the back swing or follow-through. The sway bars may also be hingedly attached to the first pair of linear members, or can be inserted into a slot on the top surface of the first pair of linear members; or the sway bars can include a universal attachment in order to attach anywhere along the linear members.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
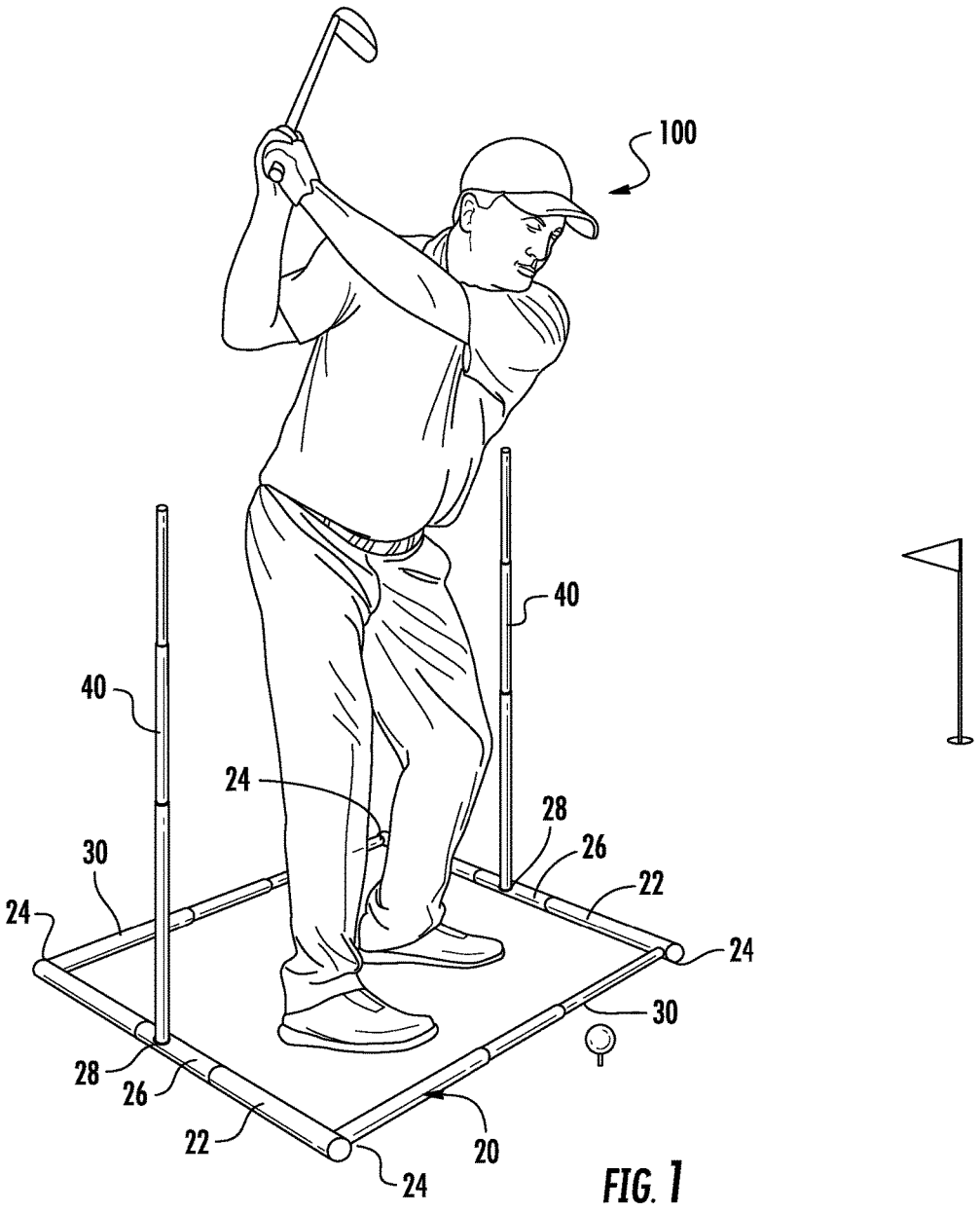
FIG. 1 is a pictorial representation of the golf training device in use with a golfer therein.

While the present invention is susceptible of embodiment in various forms, there is shown in the drawings and will hereinafter be described a presently preferred, albeit not limiting, embodiment with the understanding that the present disclosure is to be considered an exemplification of the present invention, and is not intended to limit the invention to the specific embodiments illustrated.

Referring to FIGS. 1-5, the golf training device 10 comprises a planar quadrilateral-shaped adjustable frame 20 having vertically extendable sway bars 40 that allows for a golfer 100 to establish a proper stance during a golf swing. The training device 10 is easily set up and easily moved to permit repetitive use of the training device 10 in different locations and under different circumstances. The adjustable frame 20 consists of a first pair of linear members 22, capable of telescopic movement, coupled at each end by a second pair of linear members 30, capable of telescopic movement, thereby allowing the user to expand the quadrilateral-shaped adjustable frame 20. The pairs of linear members 22 and 30 are coupled at each end by a 90 degree fixed joint 24. The sets of linear members 22 and 30 also allow the user to increase or decrease the total square area of the frame 20 according to the preferences and stance of the golfer. In the preferred embodiment, the sets of linear members 22 and 30 are adjustable from 6 inches up to 2.5 feet in length. It is contemplated that the frame 20 is constructed from lightweight materials such as, but not limited to, plastics, composites and/or metals. Each linear member 22 and 30 is comprised of a series of tubes, each having an outer diameter smaller than the preceding tubes inner diameter to allow for telescopic movement. In an alternative embodiment, shown in FIGS. 4 and 5, it is contemplated that the ends of the pair of linear members 22 and 30 are coupled together by a flexible or hinged joint 34, thereby allowing the frame 20 to be elongated or folded over upon itself for easy storage in a golf bag. The flexible or pivoting joint 34 would allow the parallel linear members 22 and 30 to be adjacent to each other, more aptly shown in FIG. 5. This creates a planar elongated reference for the golfer for alignment purposes, if need be. Although not shown, it is also contemplated that only two joints are pivoting, thereby allowing the adjustable frame to fold over and form a right angle. In this embodiment, the flexible joints would he diagonal to each other and the opposite ends would be fixed.

Figure 2:
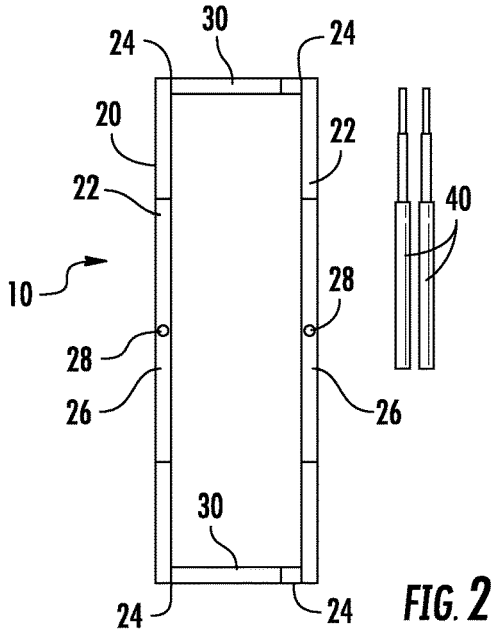
FIG. 2 is a top view of the golf training device in a storage position.
Figure 3:
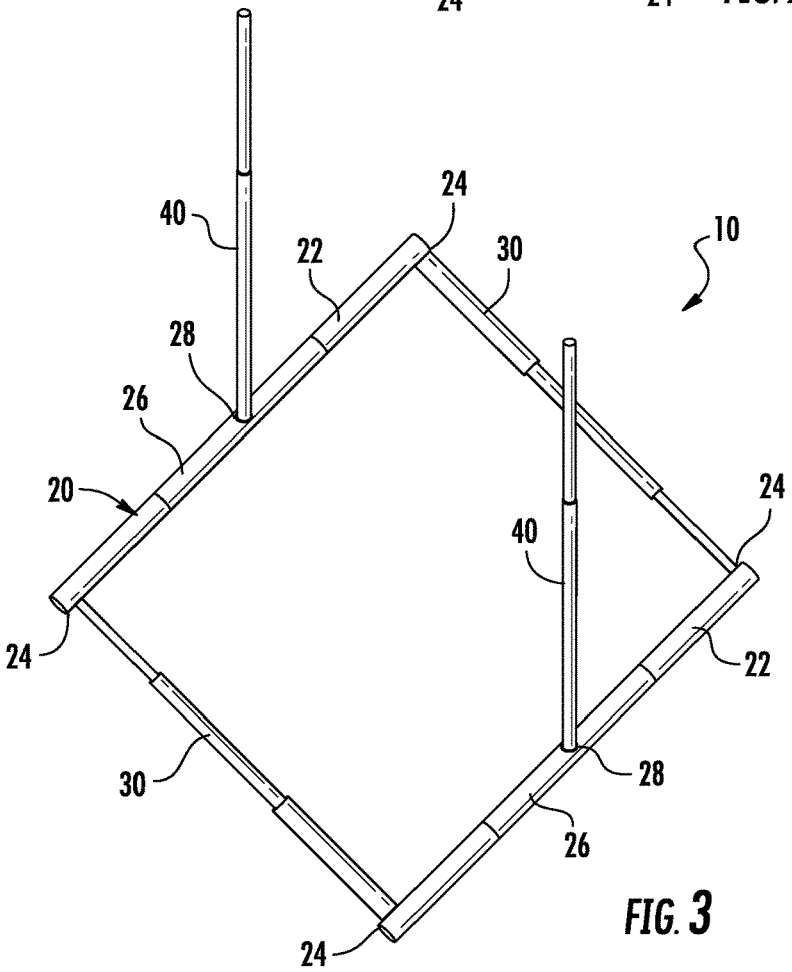
FIG. 3 is a perspective view of the golf training device.
Figure 4:
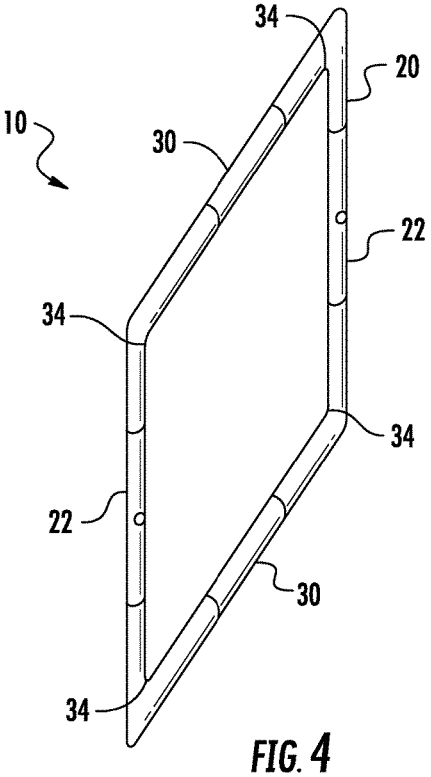
FIG. 4 is a perspective view of an alternative embodiment of the golf training device.
Figure 5:
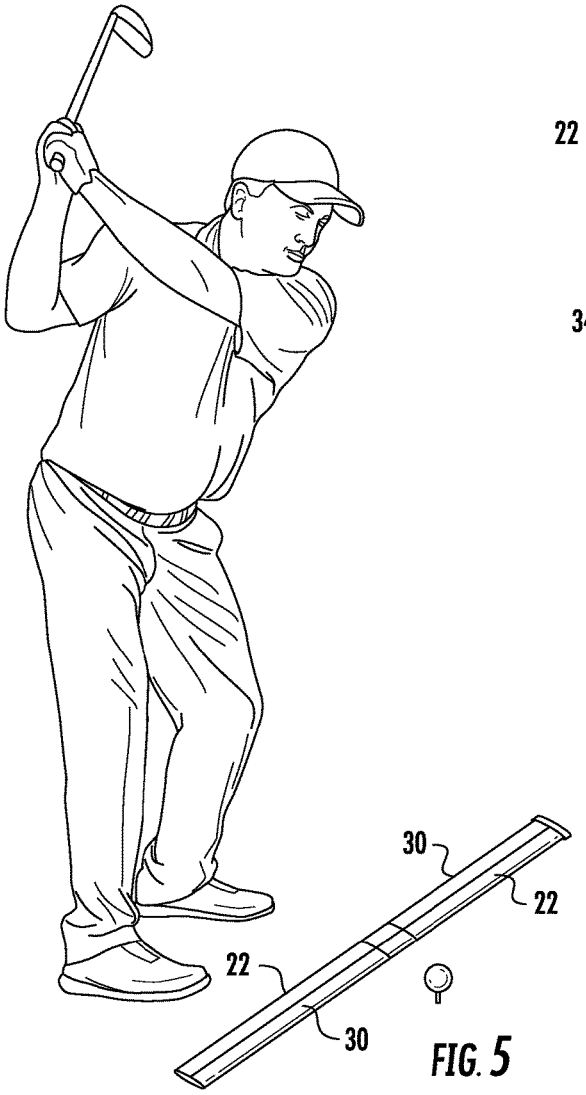
FIG. 5 is a perspective view of an alternative embodiment of the golf training device.

Furthermore, as shown in FIGS. 1-3, each top side 26 of the first pair of linear members 22 includes a slot 28 adapted to receive a vertically extendable sway bar 40. The slots 28 are positioned at the midpoint of each first linear member 22. The sway bars 40 are inserted into the slots 28 to alert the golfer 100 if he/she is "swaying" on the back swing or follow-through. In another embodiment, the sway bars may also be hingedly attached to the first pair of linear members, thereby allowing greater flex in the sway bar when contact is made. In another embodiment, the sway bars can include a universal attachment including, but not limited to, a clip, snap-lock connector, or the like, in order to attach anywhere along the linear members. The extendable sway bars 40 are also constructed of a lightweight material such as, but not limited to, plastic, composites or metal.

In an alternative embodiment, not shown, the adjustable frame consists of a pair of fixed parallel members coupled at each end by a pair of linear members, thereby allowing the user to expand the quadrilateral-shaped adjustable frame. The pair of linear members allows the user to increase or decrease the total square area of the frame according to the preferences and stance of the golfer from only one direction.

As shown in FIG. 1, in use, the golf training device is removed from the golf bag and laid on the ground. The golfer then increases the square area of the adjustable frame to a desired position, preferably with one of the linear members parallel to the ball. For a right-handed golfer (by way of example), the golfer will align one fixed member on the frame slightly left of and perpendicular to the balk then the golfer will position his front foot against the said linear member in order to address the ball properly. The golfer may also position the front linear member on the frame at or near the ball, and aligned or pointed to the intended target, being Where the golfer wants the ball to end up when hit. The golfer will then assume a stance perpendicular to the linear member in order to align his/her body with the intended target, followed by which he/she will address the ball. Alternatively, the golfer may utilize the device in its storage configuration by aligning the device in front of the user's feet as a straight edge. Lastly, the golfer may insert the extendable sway bars into the slots on the frame. The sway bars should be positioned at or near contact with the hips, with the intended purpose of making contact with the golfer's hips should the hips shift back or forward, as opposed to the preferred method of rotation of the hips.

Figure 6:
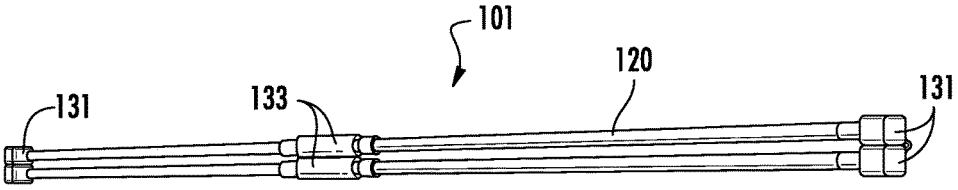
FIG. 6 is an alternative embodiment of the golf training device, illustrated in a linear training/storage arrangement.
Figure 7:
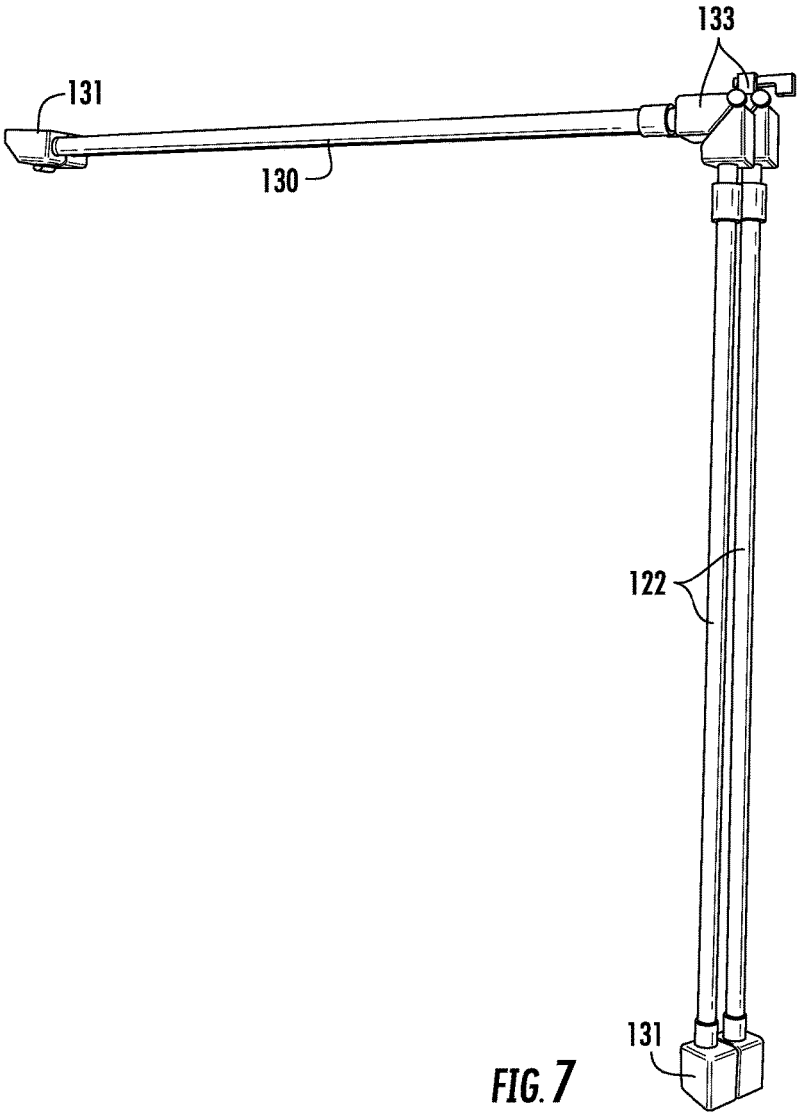
FIG. 7 is a top view of the embodiment shown in FIG. 6 illustrating the golf training device in a right angle training position.
Figure 15:
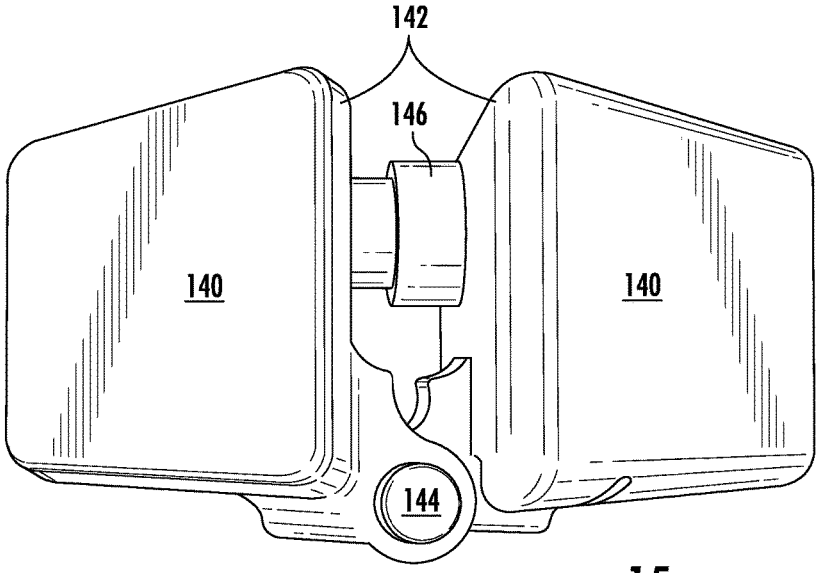
FIG. 15 is a side view of a second type of corner block suitable for use with the present device.
Figure 16:
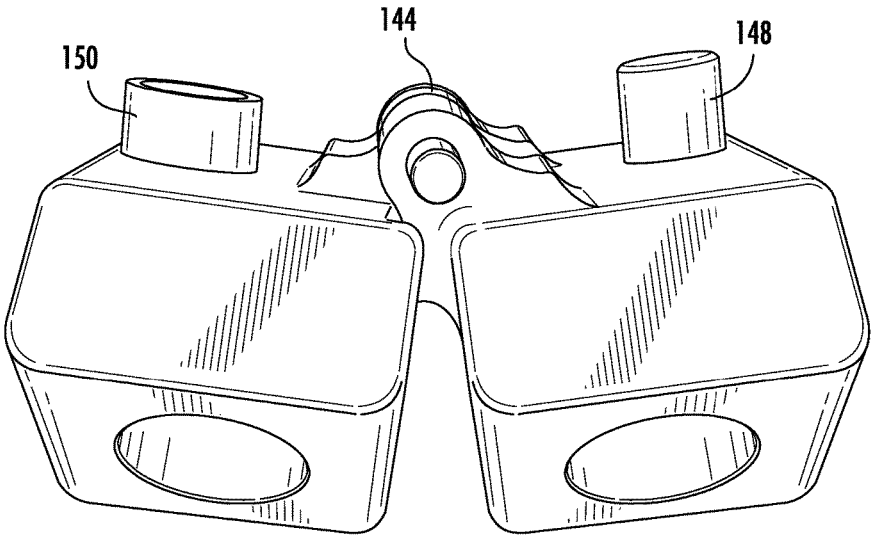
FIG. 16 is a side view of the embodiment shown in FIG. 15.
Figure 17:
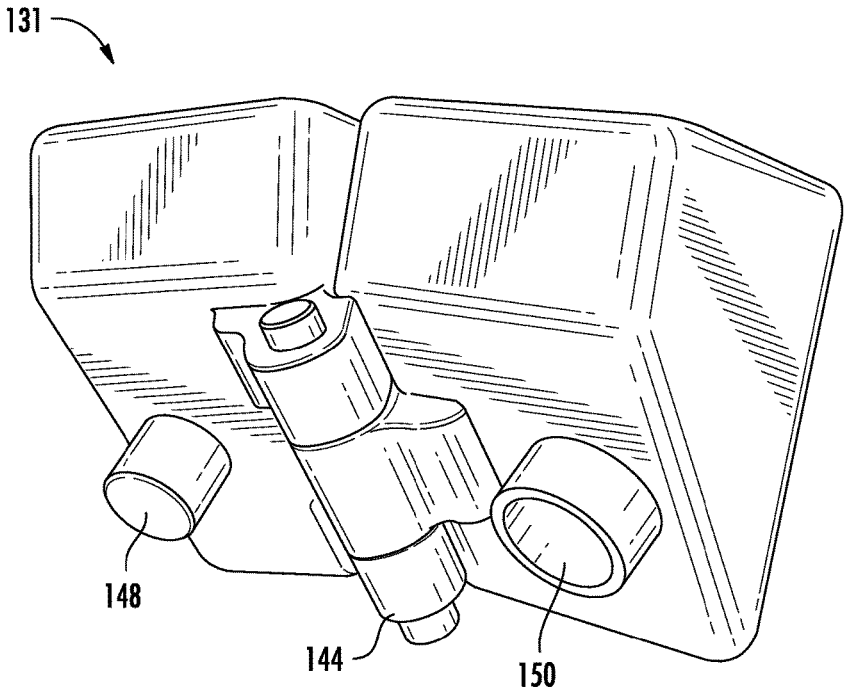
FIG. 17 is an isometric view of the second type of corner block.
Figure 18:
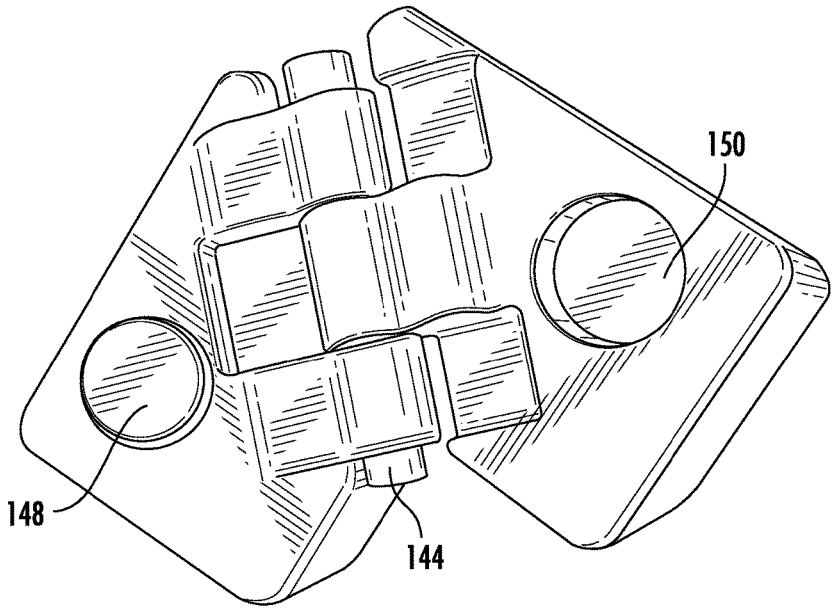
FIG. 18 is bottom view of the second type of corner block.
Figure 19:
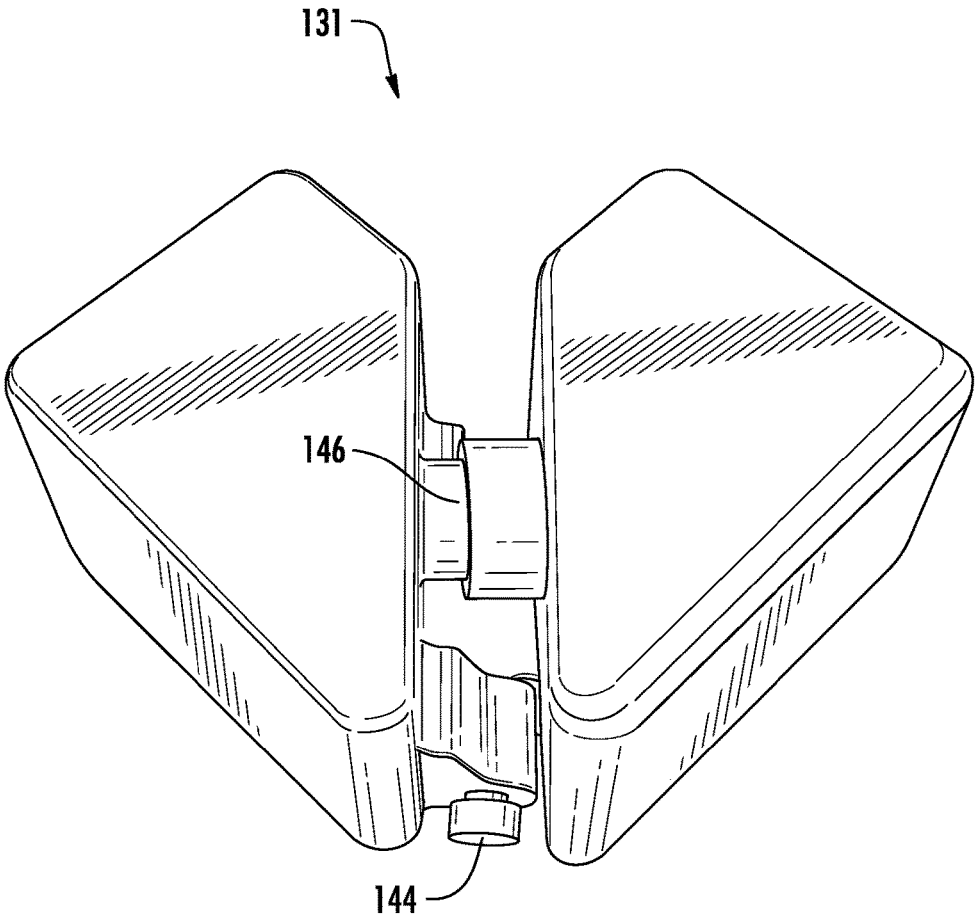
FIG. 19 is a top view of the second type of corner block.

Referring to FIGS. 6-19, the golf training device 101 comprises a planar quadrilateral-shaped adjustable frame 120 having vertically extendable sway bars 140 that allows for a golfer 100 to establish a proper stance during a golf swing. The training device is easily set up and easily moved to permit repetitive use of the training device 101 in different locations and under different circumstances. The adjustable frame 120 consists of a first pair of linear members 122 coupled at each end to a second pair of linear members 130, thereby allowing the user to expand the quadrilateral-shaped adjustable frame 120. The pairs of linear members 122 and 130 are coupled at a first end 124 by a first corner block 131, while the second ends 125 are coupled by a second corner block 133. The corner blocks 131 and 133 are constructed and arranged to allow the golf training device 101 to be arranged in a linear arrangement as shown in FIG. 6, a right angle arrangement as shown in FIG. 7, or a quadrilateral arrangement as shown in Figure The sets of linear members 122 and 130 also allow the user to increase or decrease the total square area of the frame 120 according to the preferences and stance of the golfer. In the preferred embodiment, the sets of linear members 122 and 130 are adjustable from 1 foot up to 3.5 feet in length. It is contemplated that the frame 120 is constructed from lightweight materials such as, but not limited to, plastics, composites and/or metals. Each linear member 122 and 130 is comprised of a series of tubes, each having an outer diameter smaller than the preceding tubes inner diameter to allow for telescopic movement. Referring to FIGS. 15-19, the first corner block is illustrated. The first corner block 131 includes a pair of first corner pieces 140, each corner piece including a beveled surface 142, a hinge 144 positioned along one edge of said beveled surface 142 so that said first corner pieces 140 are free to rotate with respect to each other between a first position, as illustrated in FIGS. 16 and 17, whereby the first corner pieces 140 are parallel and adjacent with respect to each other, and a second position, as illustrated in FIGS. 15, 18 and 19, whereby said first corner pieces form a right angle with respect to each other. In at least one embodiment, the beveled surface 142 of the corner pieces 140 includes a fastener 146 for securing the first corner pieces in a second position. One embodiment of the fastener 146 includes a protuberance 148 on a beveled surface of one first corner piece and a shaped cavity 150 on the beveled surface of another first corner piece; the protuberance and the cavity positioned so that the protuberance enters the cavity when the first corner pieces are positioned at right angles with respect to each other as shown in FIGS. 15 and 19. The first corner blocks may be provided with cavities, pins, or the like, for securing the second corner blocks to the linear members without departing from the scope of the invention.

Figure 13:
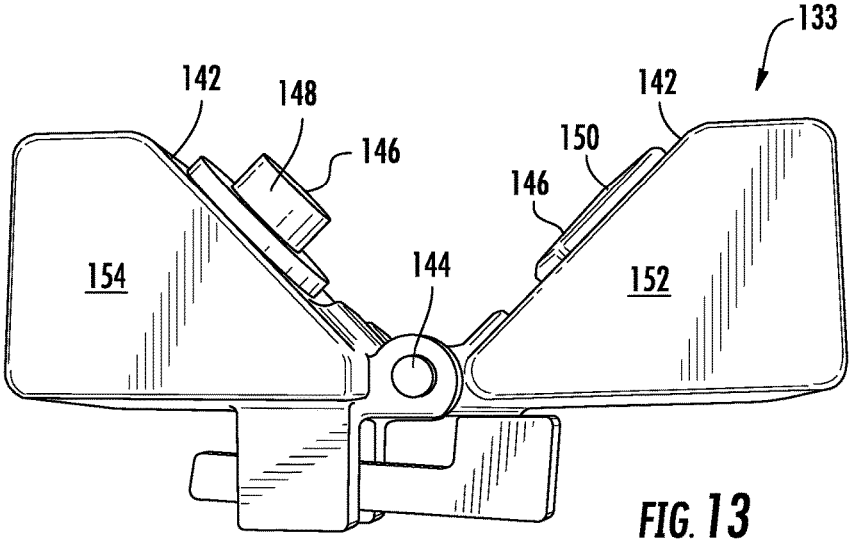
FIG. 13 is a top view of a first type of corner block suitable for use with the present device.
Figure 14:
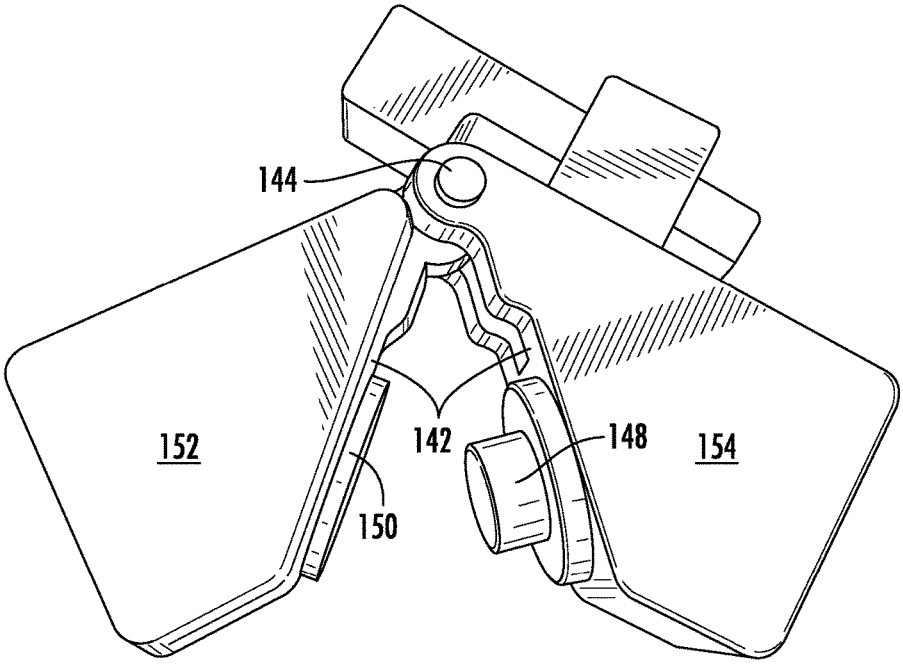
FIG. 14 is a top view of the embodiment of FIG. 13 illustrating the motion provided by the first type of corner block.

Referring to FIGS. 13 and 14, a second corner block is illustrated. The second corner block 133 is constructed from two pieces 152 and 154, and connected with a hinge 144. The hinge 144 is positioned orthogonally with respect to the longitudinal axis of the linear members 122, 130 so that the two pieces can be arranged longitudinally with respect to each other or at right angles with respect to each other. In at least one embodiment, the beveled surface 142 of the two pieces 152, 154 includes a fastener 146 for securing the second corner pieces in the second position. One embodiment of the fastener 146 includes a protuberance 148 on a beveled surface of one second corner piece 154 and a shaped cavity 150 on the beveled surface of another second corner piece 152; the protuberance 148 and the cavity 150 are positioned so that the protuberance enters the cavity when the second corner pieces are positioned at right angles with respect to each other as shown in FIGS. 7 and 8-10. The second corner blocks may be provided with cavities, pins, or the like, for securing the second corner blocks to the linear members without departing from the scope of the invention As shown in FIGS. 9-12, the linear members 122, 130 may include a vertically extendable sway bar 140. The sway bar(s) may be positioned anywhere along the length of the a embers, but are preferably positioned at the midpoint of two opposing 1 car embers.

The sway bars 140 are snapped onto the outer surface of the linear members 122, 130 to alert the golfer 100 if he/she is "swaying" on the back swing or follow-through, in another embodiment, the sway bars may also be hingedly attached to the first pair of linear members, thereby allowing greater flex in the sway bar when contact is made. In a preferred embodiment, the sway bar 140 includes a clip member 160 for attachment to the first or said second linear members. The clip 160 includes a barrel portion 162 and a vertical portion 164. The barrel portion 164 is constructed and arranged to include an inner radius 166 sized to cooperate with an outer surface of the first or said second linear members to provide friction to prevent unwanted rotation about the diameter of the first or second linear members; the barrel portion having a length that is longer than a diameter of the sway bar to prevent rotation of the sway bar in a longitudinal axis of the linear members. In this manner, the sway bars may be snapped onto the linear members and removed for storage in a golf bag. It is also contemplated that the sway bars be telescoping to provide a compact arrangement. The extendable sway bars 140 are also constructed of a lightweight material such as, but not limited to, plastic, composites or metal.

Figure 8:
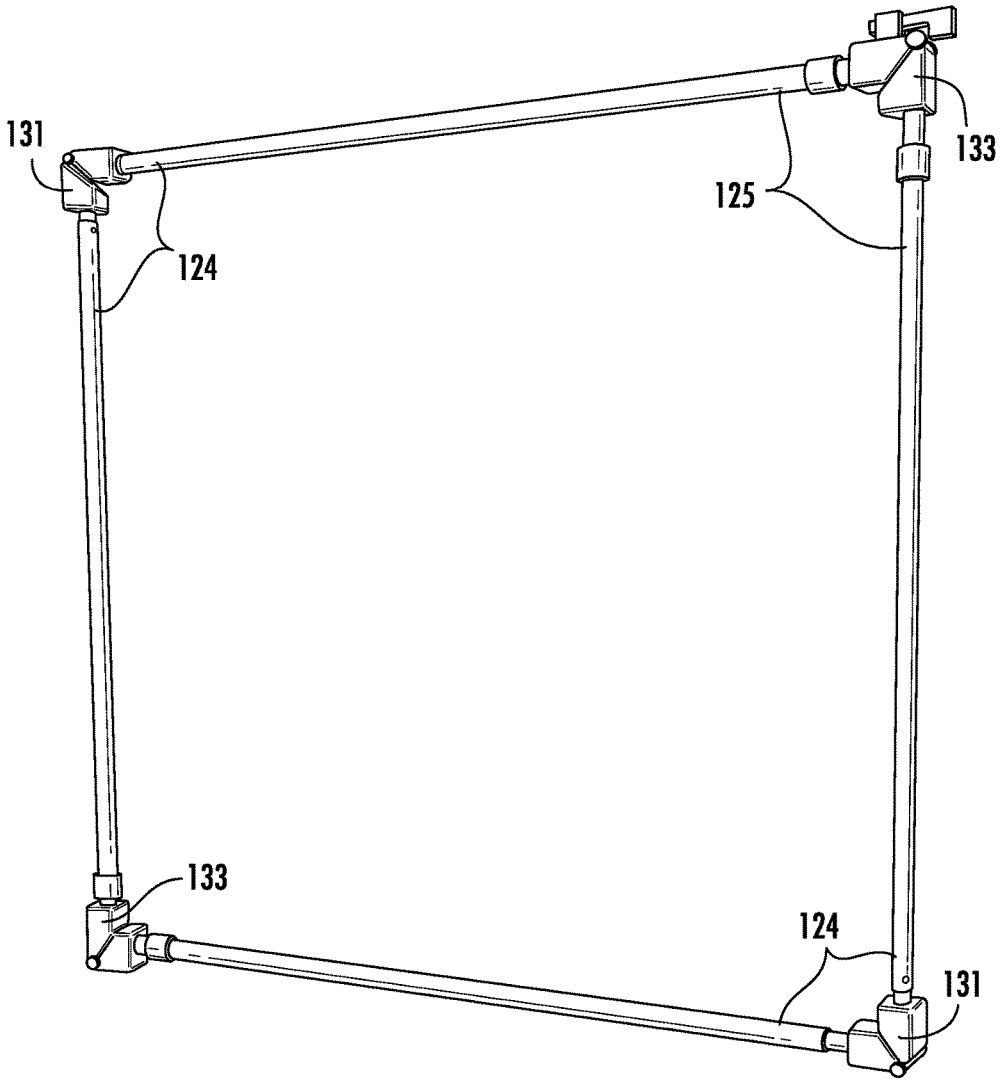
FIG. 8 is a top isometric view illustrating the golf training device in a quadrilateral training position.
Figure 9:
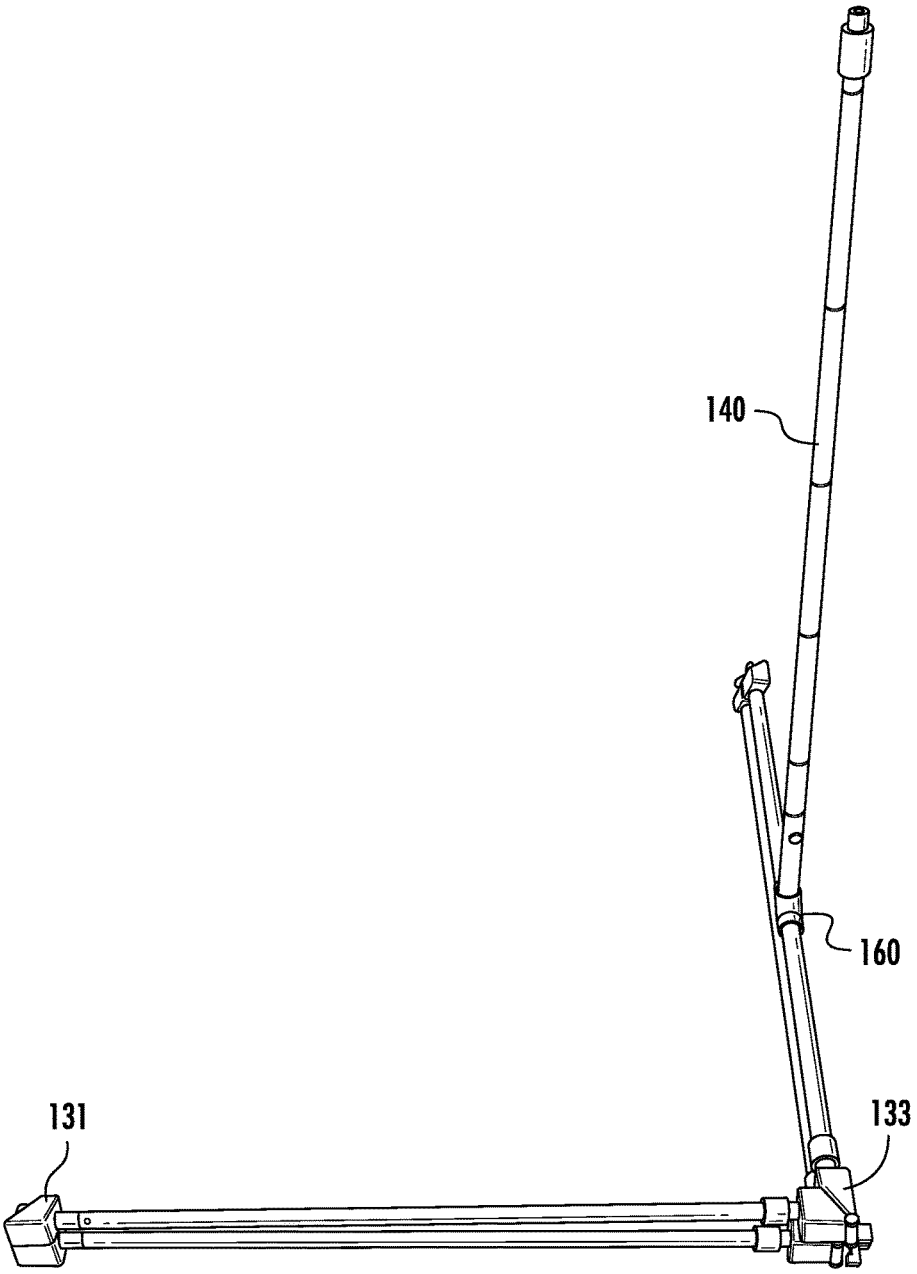
FIG. 9 is a top isometric view illustrating the golf training device of FIG. 7 illustrated with a single sway bar.
Figure 10:
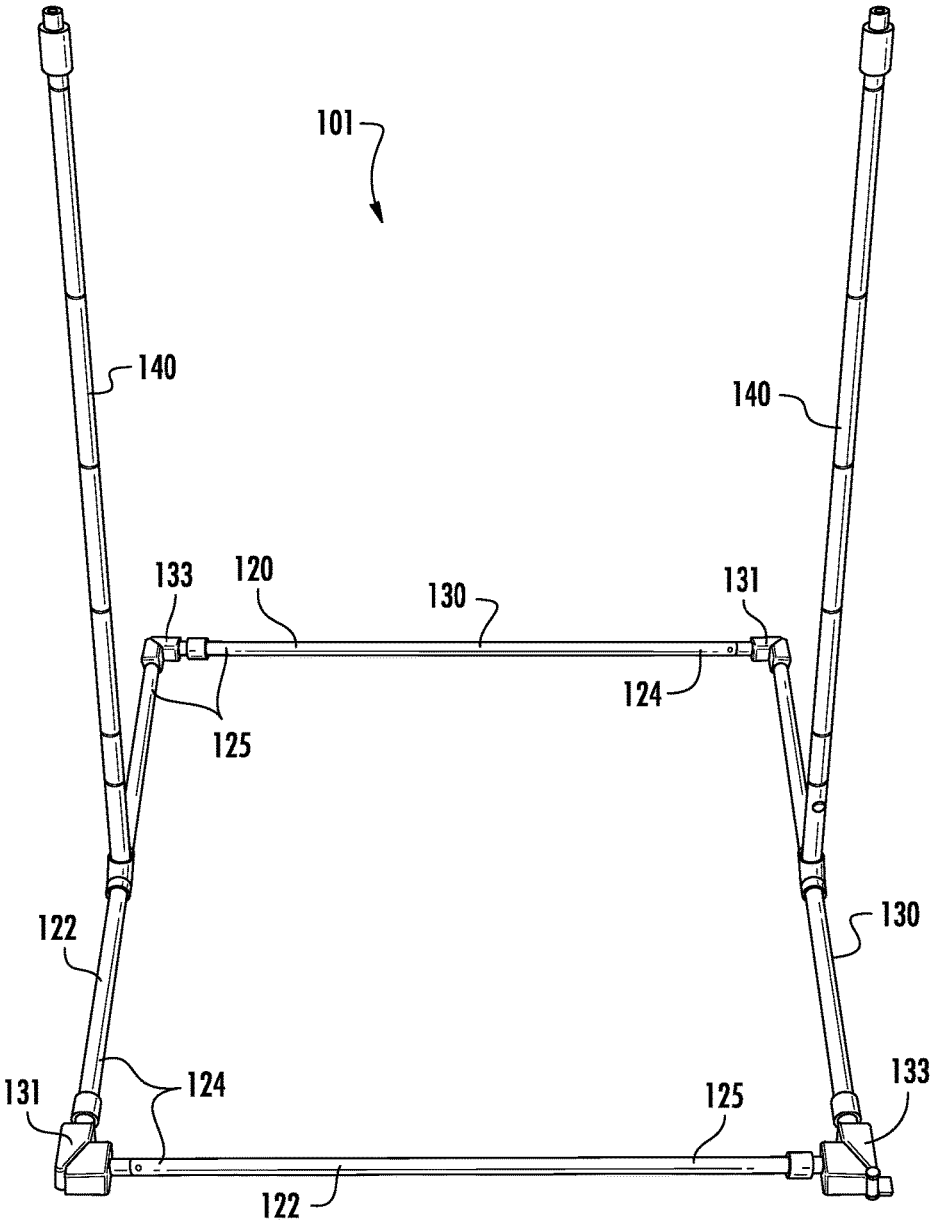
FIG. 10 is a top isometric view illustrating the golf training device of FIG. 8 with two sway bars.
Figure 11:
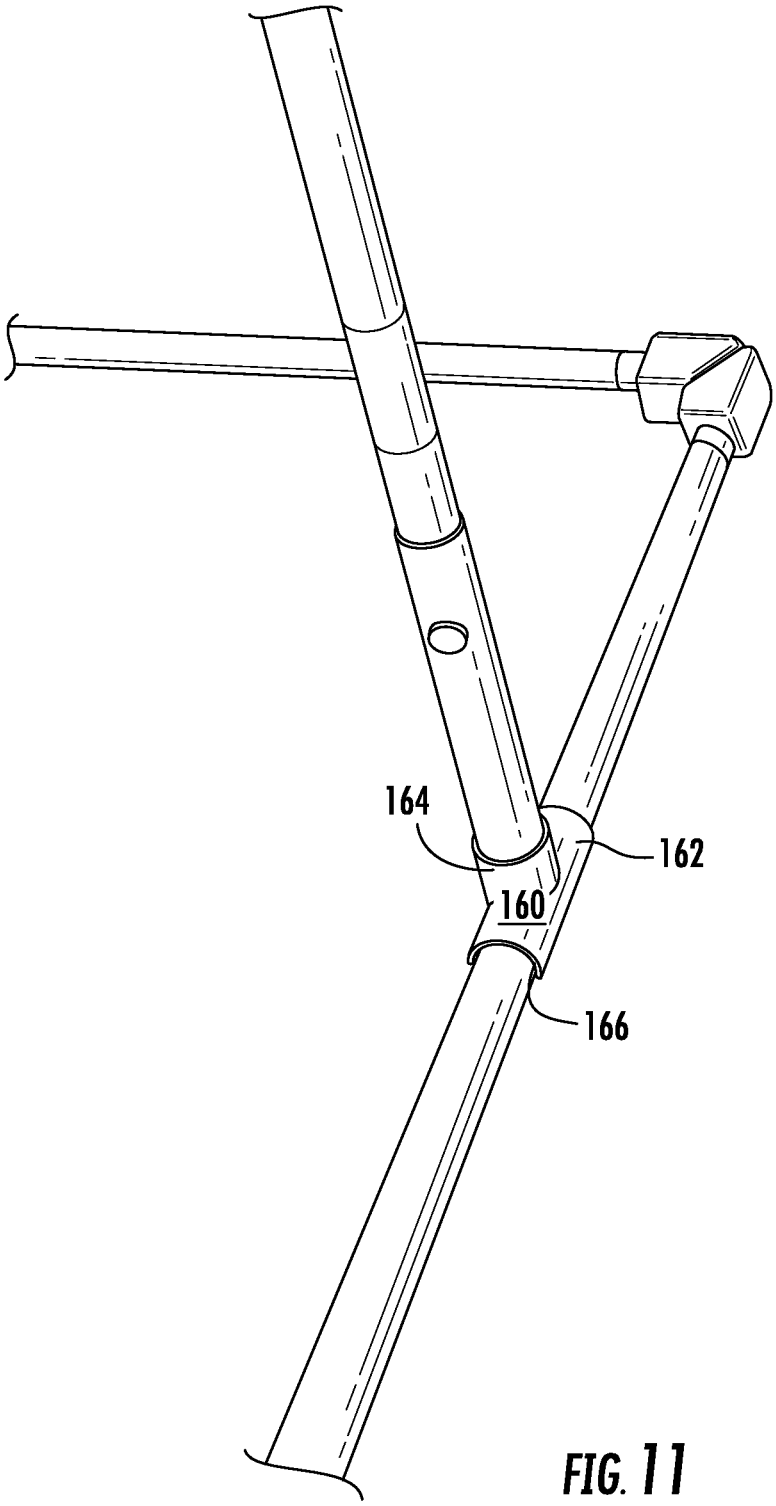
FIG. 11 is a partial top isometric view illustrating one of the corner blocks and sway bar attachment.
Figure 12:
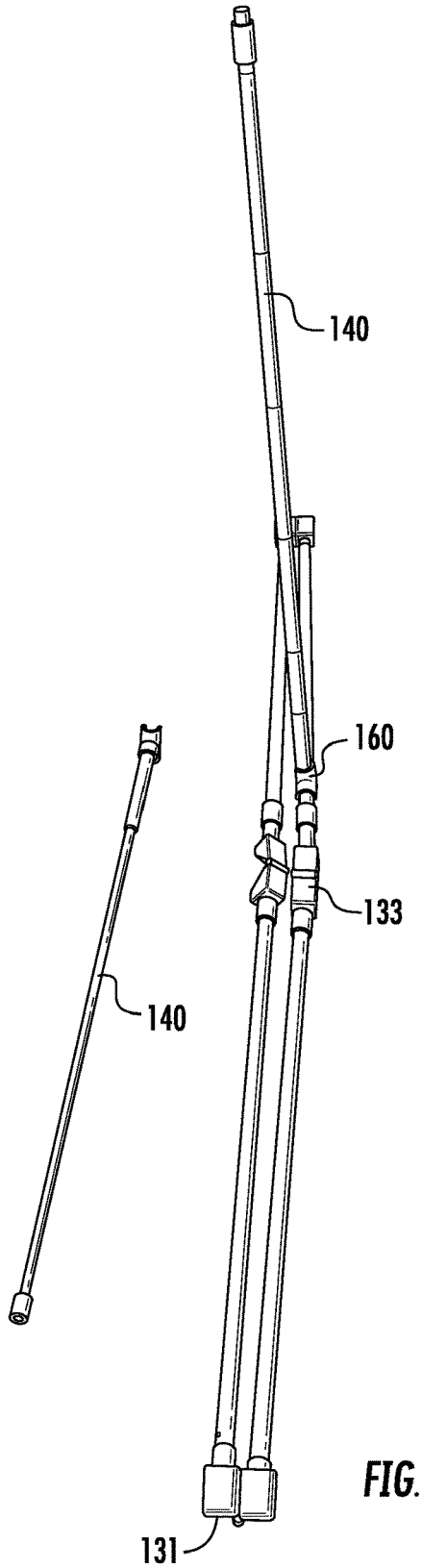
FIG. 12 is a top isometric view illustrating the embodiment of FIG. 6 with a sway bar attachment.

As shown in FIG. 6, in use, the golf training device 10 is removed from the golf bag and laid on the ground. The golfer 100 may use the golf training device in this configuration, or he may rotate the second corner blocks 133 to a right angle arrangement as shown in FIG. 7. Still yet, the golfer may then flip two of the linear members 122, 130 around the first corner blocks 131 to create the quadrilateral as shown in FIG. 8. The golfer may then increase the square area of the adjustable frame 120 to a desired size, preferably with one of the linear members parallel to the ball, For a right-handed golfer (by way of example), the golfer will align one linear member on the frame slightly left of and perpendicular to the ball; then the golfer will position his front foot against the said linear member in order to address the ball properly. The golfer may also position the frontmost linear member on the frame at or near the ball, and aligned or pointed to the intended target, being where the golfer wants the ball to end up when hit. The golfer will then assume a stance perpendicular to the linear member in order to align his/her body with the intended target, followed by which he/she will address the ball. Lastly, the golfer may attach one or two sway bars 140 onto linear members. The sway bars should be positioned at or near contact with the hips, with the intended purpose of making contact with the golfer's hips should the hips shift back or forward, as opposed to the preferred method of rotation of the hips.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A golf training device comprising:

a first pair of linear members connected with a first type corner block at a first end of each of said first pair of linear members, said first corner block includes a pair of first corner pieces, each said corner piece including a beveled surface, a hinge positioned along one edge of said beveled surface so that said first corner pieces are free to rotate with respect to each other between a first position, whereby the first corner pieces are parallel and adjacent with respect to each other, and a second position, whereby said first corner pieces form a right angle with respect to each other, said beveled surface includes a fastener for securing said first corner pieces in a second position, said fastener includes a protuberance on a said beveled surface of one said first corner piece and a shaped cavity on said beveled surface of another said first corner piece, said protuberance and said cavity positioned so that said protuberance enters said cavity when said first corner pieces are positioned at right angles with respect to each other;

a second pair of linear members connected with said first type of corner block at a first end of each of said second pair of linear members, said first type corner blocks being constructed and arranged to have an axis of rotation that is arranged at a forty five degree angle with respect to said first pair of linear members and said second pair of linear members;

a second end of said first and said second pairs of linear members connected to each other through a pair of second type corner blocks, said second type corner blocks being constructed and arranged to have an axis of rotation that is arranged orthogonally with respect to said first pair of linear members and said second pair of linear members;

whereby said golf training device may be arranged in a linear arrangement, a right angle arrangement, and a quadrilateral arrangement.

2. The golf training device of claim 1 wherein said first pair of linear members are extendable.

3. The golf training device of claim 2 wherein said first pair of linear members are telescopingly extendable.

4. The golf training device of claim 1 wherein said second pair of linear members are extendable.

5. The golf training device of claim 4 wherein said second pair of linear members are telescopingly extendable.

6. The golf training device of claim 1 including at least one vertically extending sway bar.

7. The golf training device of claim 6 wherein said sway bar is removable and replaceable to said first or said second linear members.

8. The golf training device of claim 7 wherein said sway bar includes a clip member for attachment to said first or said second linear members.

9. The golf training device of claim 8 wherein said clip includes a barrel portion and a vertical portion, said barrel portion constructed and arranged to include an inner radius sized to cooperate with an outer surface of said first or said second linear members to provide friction to prevent unwanted rotation about the diameter of said first or said second linear members, said barrel portion having a length that is longer than a diameter of said sway bar to prevent rotation of said sway bar in an axis aligned with said linear members.

10. The golf training device of claim 1 including a pair of sway bars, whereby one is positionable on opposite sides of a trainee.

11. The golf training device of claim 1 wherein said second corner block is constructed from two pieces connected with a hinge, said hinge positioned orthogonally with respect to the longitudinal axis of said linear members so that said two pieces can be arranged longitudinally with respect to each other or at right angles with respect to each other.

* * * * *